US010889949B2

(12) United States Patent
Stephan

(10) Patent No.: US 10,889,949 B2
(45) **Date of Patent: *Jan. 12, 2021**

(54) FLEXIBLE SNOWPLOW CUTTING EDGE

(71) Applicant: Michael F. Stephan, Osceola, WI (US)

(72) Inventor: Michael F. Stephan, Osceola, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/292,666

(22) Filed: Mar. 5, 2019

(65) Prior Publication Data

US 2019/0301120 A1 Oct. 3, 2019

Related U.S. Application Data

(63) Continuation of application No. 15/976,499, filed on May 10, 2018.

(60) Provisional application No. 62/505,319, filed on May 12, 2017.

(51) Int. Cl.
*E01H 5/06* (2006.01)

(52) U.S. Cl.
CPC ..... *E01H 5/066* (2013.01); *E01H 5/062* (2013.01)

(58) Field of Classification Search
CPC ..... E01H 5/066; E01H 5/062
See application file for complete search history.

(56) References Cited

U.S. PATENT DOCUMENTS 592,010 A 10/1897 Lamborn
1,383,409 A 7/1921 Liddell
1,609,353 A 12/1926 Heflin
2,055,291 A 9/1936 Henry
2,116,351 A 5/1938 Jones
2,337,434 A 12/1943 Washbond
2,615,707 A 10/1952 Rowe et al.
2,650,088 A 8/1953 Formanek
2,697,289 A 12/1954 Standfuss
(Continued)

FOREIGN PATENT DOCUMENTS

CA 2717986 A1 9/2009
CA 2698744 A1 10/2011
(Continued)

OTHER PUBLICATIONS

Application and File History for U.S. Appl. No. 15/976,499, filed May 10, 2018. Inventor: Michael F. Stephan.

*Primary Examiner* — Jamie L McGowan
(74) *Attorney, Agent, or Firm* — Patteson Thuente Pedersen, P.A.

(57) ABSTRACT

A snow plow cutting edge, including at least one elongate backing plate removably fastened to a lower edge of a snow plow moldboard or to a cutting edge trip mechanism. The elongate backing plate has a long axis and a plurality of biasing member engaging structures. Slide bars are engaged to the elongate backing plate. The slide bars are arranged proximate one another along the long axis of the elongate backing plate and are slidable generally perpendicular to the long axis. Biasing members are engaged between the biasing member engaging structures and the slide bars such that the slide bars are biased generally perpendicular to the long axis toward a surface to be cleared of snow. Replaceable cutting edge sections are removably attached to one of the plurality of slide bars and located adjacent at least one of the other replaceable cutting edge sections.

11 Claims, 7 Drawing Sheets

(56) References Cited

U.S. PATENT DOCUMENTS

| | | | | |
|---|---|---|---|---|
| 2,775,830 | A | 1/1957 | Kenyon | |
| 2,962,821 | A | 12/1960 | Peitl | |
| 3,014,289 | A | 12/1961 | Torrey | |
| 2,199,234 | A | 8/1965 | Reissinger | |
| 3,231,991 | A | 2/1966 | Wandscheer et al. | |
| 3,400,475 | A | 9/1968 | Peitl | |
| 3,465,456 | A | 9/1969 | Meyer | |
| 3,503,601 | A | 3/1970 | Wells | |
| 3,547,203 | A | 12/1970 | Jackoboice | |
| 3,650,498 | A | 3/1972 | Deak | |
| 3,772,803 | A * | 11/1973 | Cote | E01H 5/062 37/233 |
| 3,808,714 | A | 5/1974 | Reissinger et al. | |
| 4,031,966 | A | 6/1977 | Farrell | |
| 4,079,926 | A | 3/1978 | Nunes | |
| 4,249,323 | A | 2/1981 | Mathis et al. | |
| 4,307,523 | A | 12/1981 | Reissinger et al. | |
| 4,529,080 | A | 7/1985 | Dolan | |
| 4,570,366 | A | 2/1986 | Yost | |
| 4,597,202 | A | 7/1986 | Weeks | |
| 4,669,205 | A | 6/1987 | Smathers | |
| 4,681,303 | A | 7/1987 | Grassano | |
| 5,140,763 | A * | 8/1992 | Nichols, IV | E01H 5/062 37/233 |
| 5,191,729 | A | 3/1993 | Verseef | |
| 5,263,695 | A | 11/1993 | Bianchi | |
| 5,344,254 | A | 9/1994 | Sartain | |
| 5,437,113 | A | 8/1995 | Jones | |
| 5,697,172 | A | 12/1997 | Verseef | |
| 5,720,122 | A | 2/1998 | McLellan | |
| 5,743,032 | A * | 4/1998 | Vauhkonen | E01H 5/062 37/446 |
| 5,746,017 | A | 5/1998 | Marvik | |
| 5,819,443 | A | 10/1998 | Winter | |
| 5,819,444 | A | 10/1998 | Desmarais | |
| 5,899,007 | A | 5/1999 | Niemela et al. | |
| 6,035,944 | A | 3/2000 | Neuner et al. | |
| 6,073,371 | A | 6/2000 | Goos et al. | |
| 6,345,583 | B1 | 2/2002 | Thackston et al. | |
| 6,618,965 | B1 | 9/2003 | Schultz et al. | |
| 6,701,646 | B2 | 3/2004 | Schultz et al. | |
| 6,751,894 | B2 | 6/2004 | Verseef | |
| 6,817,118 | B2 | 11/2004 | Schmeichel | |
| 6,823,615 | B2 | 11/2004 | Strait | |
| 6,892,480 | B1 | 5/2005 | Gledhill et al. | |
| 6,922,924 | B2 | 8/2005 | Jones et al. | |
| 7,100,311 | B2 | 9/2006 | Verseef | |
| 7,100,314 | B1 | 9/2006 | Jensen | |
| 7,107,709 | B2 * | 9/2006 | Hamel | E01H 5/062 172/264 |
| 7,134,227 | B2 | 11/2006 | Quenzi et al. | |
| 7,171,770 | B2 | 2/2007 | Schultz et al. | |
| 7,263,789 | B2 | 9/2007 | Hollinrake et al. | |
| 7,350,774 | B2 | 4/2008 | Chun et al. | |
| 7,467,485 | B2 * | 12/2008 | Lachance | E01H 5/062 172/264 |
| 7,493,710 | B2 | 2/2009 | Frey et al. | |
| 7,543,401 | B2 | 6/2009 | Hughes | |
| 7,555,853 | B2 | 7/2009 | Paonessa | |
| 7,631,441 | B2 | 12/2009 | Hunt | |
| 7,658,022 | B2 | 2/2010 | Strait | |
| 7,681,335 | B2 | 3/2010 | Schmeichel | |
| 7,730,643 | B2 | 6/2010 | Mishra et al. | |
| 7,743,536 | B2 | 6/2010 | Evans et al. | |
| 7,841,109 | B2 | 11/2010 | Stevens et al. | |
| 7,908,775 | B2 | 3/2011 | Mishra et al. | |
| 8,069,590 | B2 | 12/2011 | Schmeichel | |
| 8,499,477 | B2 | 8/2013 | Gamble, II | |
| 8,776,405 | B2 * | 7/2014 | Paonessa | E01H 5/06 37/232 |
| 9,051,700 | B2 | 6/2015 | Summers et al. | |
| 9,200,418 | B2 | 12/2015 | Jones et al. | |
| 9,255,370 | B2 | 2/2016 | Paonessa | |
| 9,388,544 | B2 | 7/2016 | Reeves et al. | |
| 9,528,234 | B1 * | 12/2016 | Pigeon | E01H 5/065 |
| 9,611,604 | B2 * | 4/2017 | Vigneault | E01H 5/062 |
| 10,119,233 | B2 | 11/2018 | Holman | |
| 10,329,087 | B2 | 6/2019 | Holman | |
| 10,358,782 | B2 | 7/2019 | Holman | |
| 10,435,864 | B2 | 10/2019 | Holman | |
| 10,480,140 | B2 * | 11/2019 | Vigneault | E01H 5/062 |
| 2003/0066738 | A1 | 4/2003 | Veenhof | |
| 2013/0174452 | A1 | 7/2013 | Diehl et al. | |
| 2015/0101216 | A1 | 4/2015 | Kerr et al. | |
| 2017/0218585 | A1 | 8/2017 | Vigneault | |
| 2017/0218597 | A1 | 8/2017 | Holman | |
| 2017/0284045 | A1 | 10/2017 | Holman | |
| 2017/0370060 | A1 | 12/2017 | Holman | |
| 2019/0002199 | A1 | 1/2019 | Holman | |
| 2019/0276999 | A1 | 9/2019 | Holman | |
| 2020/0024824 | A1 | 1/2020 | Holman | |

FOREIGN PATENT DOCUMENTS

| | | | |
|---|---|---|---|
| CA | 2723630 | A1 | 6/2012 |
| CH | 313333 | A | 4/1956 |
| CH | 382207 | A | 9/1964 |
| CH | 678344 | | 8/1991 |
| CN | 2903176 | U | 5/2007 |
| CN | 201866149 | U | 6/2011 |
| CN | 203346934 | U | 12/2013 |
| CN | 103498444 | U | 1/2014 |
| CN | 205100150 | U | 3/2016 |
| CN | 205387727 | U | 7/2016 |
| DE | 1299675 | B | 7/1969 |
| DE | 3608893 | A1 | 9/1987 |
| DE | 3711988 | A1 | 10/1988 |
| DE | 8811708 | U1 | 5/1989 |
| EP | 0849401 | B1 | 3/2002 |
| EP | 1247906 | A2 | 10/2002 |
| EP | 2154294 | A1 | 2/2010 |
| FR | 1050311 | A | 1/1954 |
| FR | 2179703 | A1 | 11/1973 |
| FR | 2269608 | A1 | 11/1975 |
| FR | 2349683 | A1 | 11/1977 |
| FR | 2448599 | A1 | 9/1980 |
| GB | 402584 | A | 12/1933 |
| GB | 766042 | A | 8/1952 |
| GB | 1015307 | A | 9/1954 |
| JP | 55061623 | A | 5/1980 |
| JP | 2005068908 | A | 3/2005 |
| JP | 6004904 | B2 | 10/2016 |
| KR | 200422656 | Y1 | 7/2006 |
| WO | WO 2010/015992 | A2 | 2/2010 |
| WO | WO 2018/126324 | A1 | 7/2018 |

* cited by examiner

FLEXIBLE SNOWPLOW CUTTING EDGE

CROSS-REFERENCE TO RELATED APPLICATIONS

This application is a continuation of application Ser. No. 15/976,499, filed May 10, 2018 entitled "Flexible Snowplow Cutting Edge," which claims the benefit of U.S. Provisional Application No. 62/505,319, filed May 12, 2017, each of which is hereby fully incorporated herein by reference.

TECHNICAL FIELD

Embodiments of the invention relate to snow removal equipment and snow plows. More particularly, they relate to snow plow moldboards or trip edges with a replaceable cutting edge.

BACKGROUND

Snow plows typically have wearable cutting edges that contact the surface to be plowed. Because they are in moving contact with the surface to be plowed and the surface to be plowed generally has abrasive qualities the cutting edges are subject to considerable wear. They are considered to be consumable and replaceable.

These wearable cutting edges are commonly made from a wear resistant steel, plastic, or polyurethane material. While the plow itself may offer some float, or oscillation to help follow uneven contours of the plowing surface, usually the cutting edge itself remains rigid in a straight line. This prevents the plow from cleaning the snow out of small dips or valleys in the plowing surface. If a surface is not completely clear of snow, the surface may present safety hazards and may represent poor workmanship as viewed from the standpoint of a purchaser of snow removal services.

Snow plowing is the process of removing snow from a surface to allow for pedestrians and vehicle traffic to pass unhindered. The surfaces that are being plowed are never perfectly flat, and this poses a problem for most snow plows and their ability to clean the plowing surface effectively. Many snow plows utilize some sort of float, or oscillation feature, to help the plow moldboard follow contours and elevation changes in the plowing surface. This feature, however, only allows the cutting edge of the plow to adjust in horizontal tilt from one end to the other. In other words, the smallest dip in the surface being plowed that the plow will drop into is as wide as the snow plow itself. Many commercial plows are sized between 6 feet and 14 feet wide. As a plow in this size range travels along over the normal humps and dips in the pavement surface to be cleared, the plow is only cleaning down to a depression that it can fit into.

For instance, as the plow is pushed along over a manhole cover that is elevated about one inch above the surrounding area, the cutting edge of the plow will elevate to that manhole cover height, leaving much of the snow surrounding the manhole cover for the remaining about 6 to 14 feet at a depth of up to the one inch height of the man hole cover. Likewise, if the plow encounters a small dip about one foot in diameter, a normal rigid cutting edge will not allow the removal of snow from the dip because the edge is held at the higher elevation of the surrounding surfaces. The cutting edge "bridges" the dip and does not remove the snow from the depressed area.

The problem associated with dips and humps in the plowing surface can be solved by a cutting edge that naturally contours better to the pavement and uneven surfaces.

Efforts exist in the prior art to address these problems. For example, U.S. Pat. No. 9,611,604 to Vigneault and U.S. Pat. No. 6,823,615 to Strait disclose attempts to address these problems.

Most snow plows utilize a "trip edge," or a "trip moldboard" type safety "trip," or "breakaway" type mechanism. That is, either the cutting edge of the plow or the entire moldboard are adapted to give way if they encounter an obstacle that would otherwise damage the cutting edge, the moldboard or the supporting structure that couples the plow to the prime mover to which it is connected. Such mechanisms are common, and allow the entire moldboard or cutting edge to "trip" or release when encountering immovable obstacles. Typically, these mechanisms are spring-loaded or otherwise biased in such a way that once the obstacle is surmounted or passed the cutting edge or the moldboard returns to its prior position so that plowing can continue without further interruption.

However, there still remains room for improvement in the snowplowing arts with regard to completely clearing snow from uneven surfaces.

SUMMARY

Embodiments of the invention address many of the problems that exist in the snowplowing arts as related to clearing snow from uneven surfaces.

Prior art efforts to address the common problem of plowing and effectively clearing uneven surfaces lack an ability to adapt technology to the many brands and designs of existing snow plows. Embodiments of the invention disclosed herein address the common problem associated with clearing uneven surfaces and can be adapted to most common snow plows, new or existing. As discussed above, most common snow plows have a replaceable cutting edge. Embodiments of the invention are adapted to take the place of a rigid, replaceable cutting edge, thereby providing the operator of a prior art snow plow a new and improved snow plow that is able to follow uneven surfaces, without having to change to an entirely new snow plow, hitch mechanism, truck, and any other necessary changes that have to be made in order to utilize the existing technology such as that disclosed by Vigneault or Strait.

Example embodiments of the invention utilize multiple cutting edge sections that travel independently from each other in a direction generally parallel to a long axis of the cutting edge that meets the plowed surface. Example embodiments of the invention allow the plow to scrape into the dips, and absorb the humps that are commonly encountered when removing snow from surfaces, producing a cleaner plowed surface. Example embodiments of the invention can be retrofitted to most existing snow plows. Prior art devices such as those disclosed by Strait and Vigneault prior art also demonstrate sections that individually trip back upon encountering an obstacle. It is expected that embodiments of the invention will make it unnecessary to have multiple, or separate trip mechanisms. In most cases, the original safety trip mechanism of the plow to which embodiments of the invention can be secured, such as by bolts, is utilized without modification.

The above summary is not intended to describe each illustrated embodiment or every implementation of the subject matter hereof. The figures and the detailed description that follow more particularly exemplify various embodiments.

BRIEF DESCRIPTION OF THE DRAWINGS

Subject matter hereof may be more completely understood in consideration of the following detailed description of various embodiments in connection with the accompanying figures, in which.

DETAILED DESCRIPTION

Figure 1:
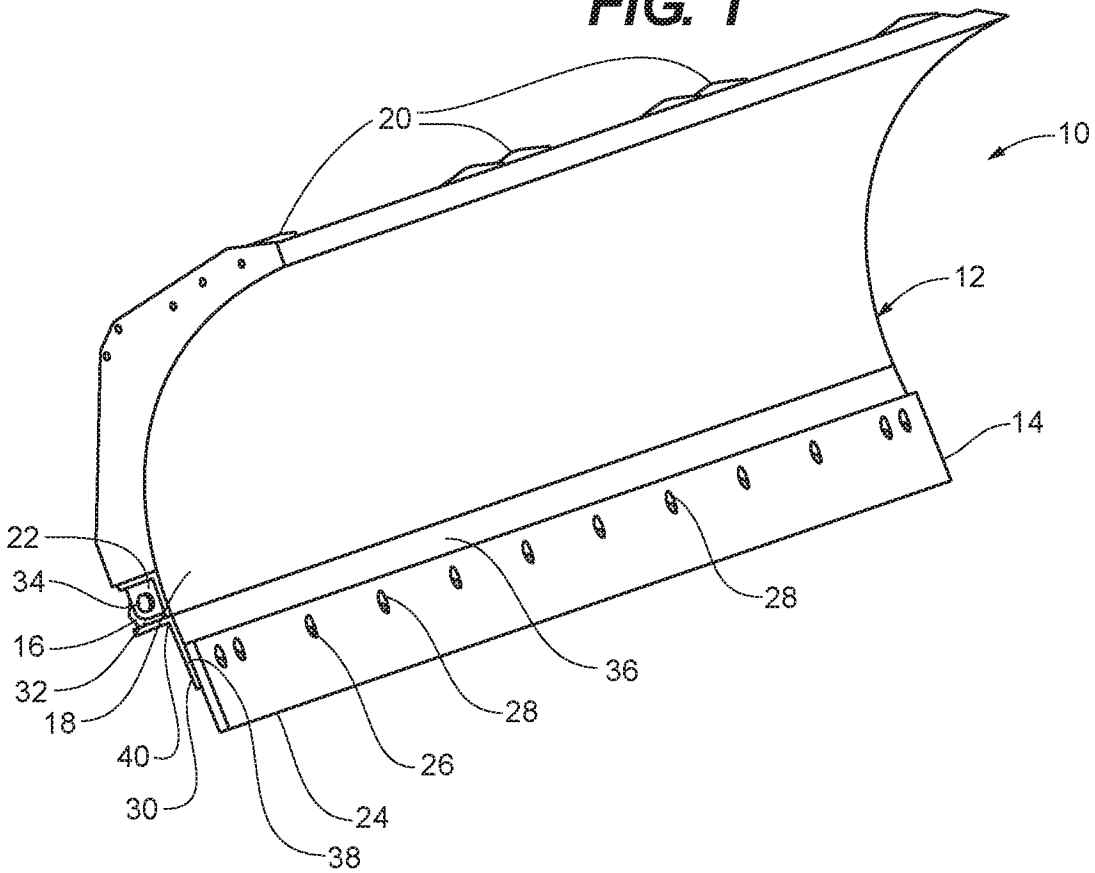
FIG. 1 is a perspective view of a prior art snow plow having a trip cutting edge at a bottom of its moldboard.

Referring to FIG. 1, a conventional prior art snow plow blade 10 is depicted. Snow plow blade 10 represents a so-called trip edge snow plow blade 10. Snow plow blade 10 as depicted in FIG. 1 generally includes moldboard 12, cutting edge 14 and cutting edge trip mechanism 16. Moldboard 12 generally includes a curved panel 18, curved panel supports 20 and trip edge axle supports 22.

Cutting edge 14 is a wearing part because of its contact with pavement or other surfaces to be cleared of snow. Accordingly, cutting edge 14 is replaceable and generally includes cutting edge plate 24, fasteners 26 and fasteners receiving holes 28.

Cutting edge trip mechanism 16 generally includes cutting edge support structure 30, axle couplers 32, trip edge axle 34 and trip edge biasing structure (not shown). In the depicted prior art structure, cutting edge support structure 30 is formed from a length of structural angle 36 having long leg 38 and short leg 40. Long leg 38 supports cutting-edge 14 and is coupled thereto by fasteners 26 which pass through fastener receiving holes 28 and cutting-edge 14. Short leg 40 is secured to axle couplers 32, typically by welding. Trip edge axle 34 passes through axle couplers 32 and trip edge axle supports 22 such that cutting-edge support structure 30 is rotatably coupled to moldboard 12. Trip edge biasing structure or biasing structures (not shown) are adapted and structured to bias cutting-edge support structure 30 toward the position depicted in FIG. 1. Trip edge biasing structure may include for example, tension, compression or torsional springs.

Figure 2:
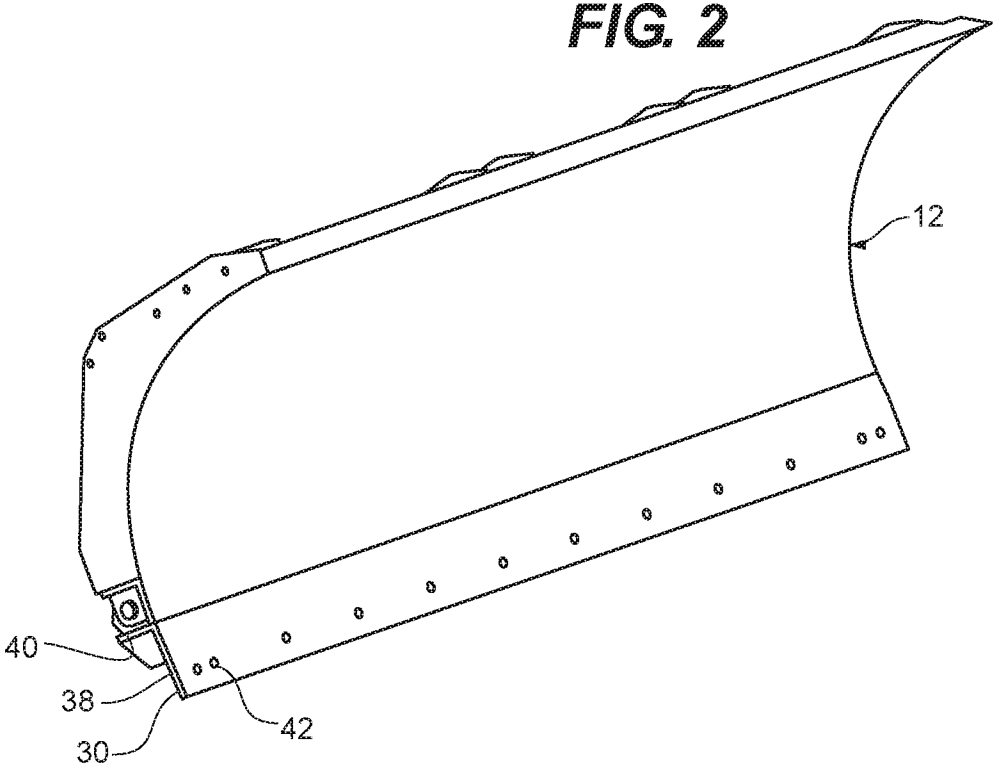
FIG. 2 is a perspective view of a prior art snow plow having its rigid replaceable cutting edge removed.

Referring now to FIG. 2, cutting-edge support structure 30 is depicted with cutting-edge 14 removed therefrom. In the depicted prior art structure cutting-edge support structure 30 presents a plurality of bolt holes 42. Bolt holes 42 may be threaded or may receive threaded studs (not shown) therethrough.

According to example embodiments of the invention flexible snowplow cutting edge 41 is coupled to cutting-edge support structure 34, for example, via bolt holes 42 or by other fastening schemes known to those of skill in the art. Example embodiments of the invention may also be attached or coupled directly to moldboard 12 in the case of a prior art moldboard 12 coupled to a trip mechanism which allows the entirety of moldboard 12 to trip or release in the event of contact with an obstruction.

Referring now to FIGS. 3-7, according to an example embodiment, flexible snowplow cutting edge 41 generally includes backing plate 44, side supports 46, slide bars 48, biasing members 50 and cutting-edge sections 52.

Figure 3:
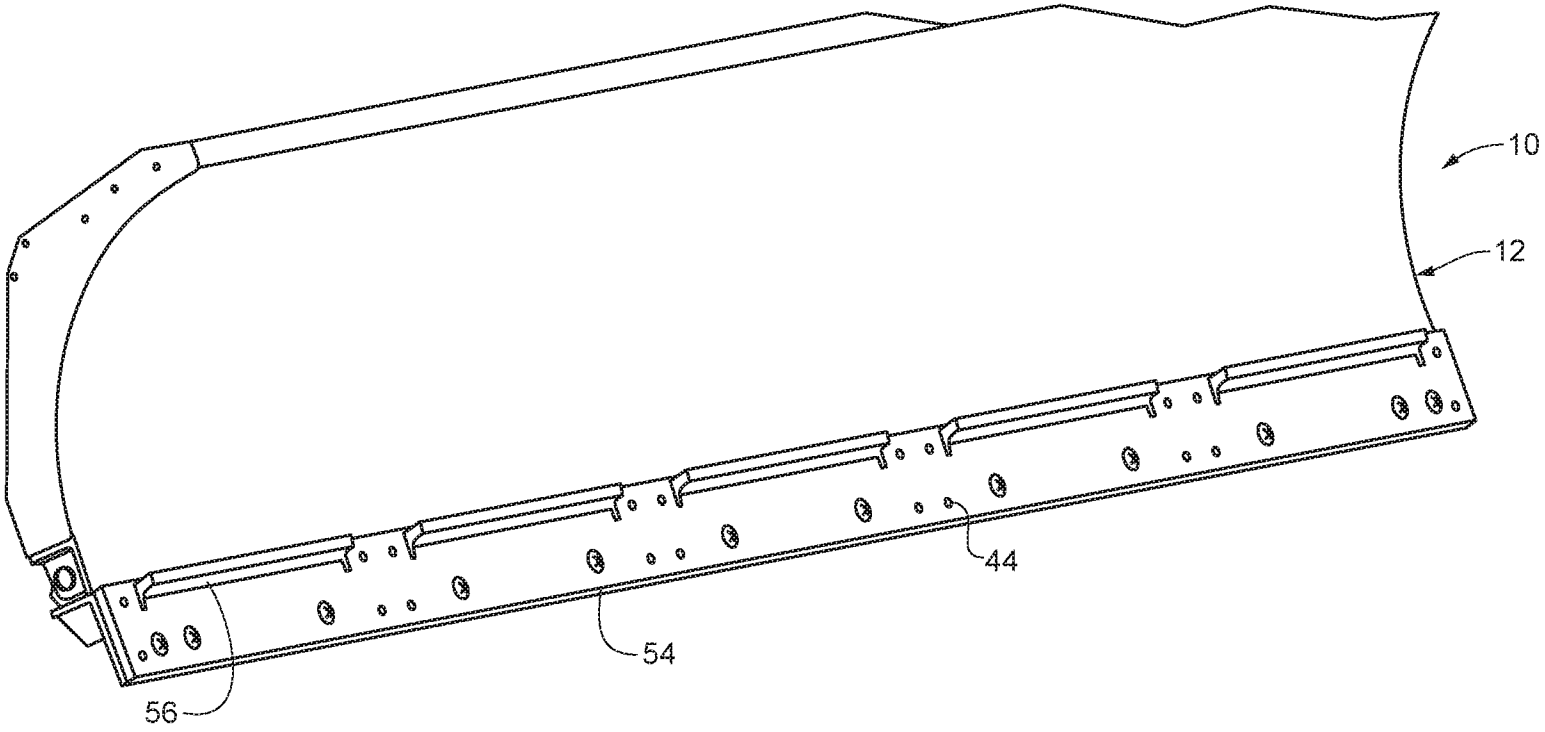
FIG. 3 is a perspective view of a backing plate installed according to an example embodiment of the invention.

Referring now to FIG. 3 backing plate 44 is a generally unitary structure in the depicted embodiment. Backing plate 44 may also be formed as multiple backing plate sections particularly in the case of prior art snow plow blades 10 of greater length.

Backing plate 44 generally includes elongate plate structure 54 supporting at least one and likely, a plurality of biasing member bosses 56. Biasing member bosses 56, in the depicted embodiment, extend outwardly from the elongate plate structure 54 generally perpendicularly to elongate plate structure 54. In the context of the relationship between elongate plate structure 54 and biasing member bosses 56, generally perpendicularly should be understood to mean that biasing member bosses 56 meet elongate plate structure 54 at an angle between 70 and 110 degrees. According to the depicted example embodiment biasing member bosses 56 have a long axis extending parallel to a long axis of backing plate 44.

In the depicted embodiment backing plate 44 is secured to cutting-edge support structure 30. However, backing plate 44 may be integrally formed with cutting-edge support structure 34 or with moldboard 12 so that biasing member bosses 56 are present directly on cutting-edge support structure 30 or on moldboard 12 such that structures discussed below may be directly attached thereto.

Figure 4:
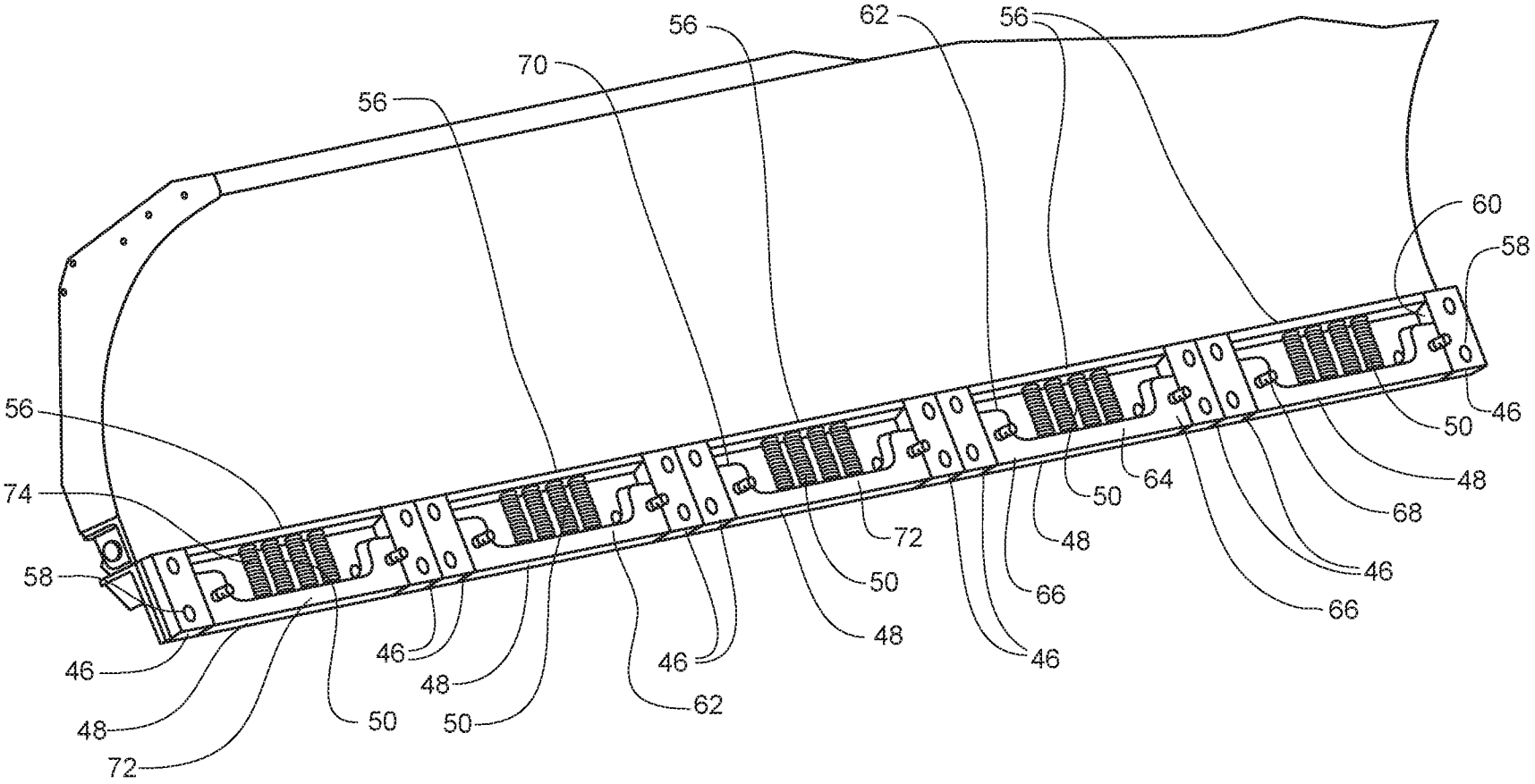
FIG. 4 is a perspective view of an example embodiment of the invention partially assembled on the backing plate.

Referring particularly to FIG. 4, side supports 46 are secured to backing plate 44 for example by side support fasteners 58 passing therethrough. Side supports 46 are secured to backing plate 44 separated by a distance approximately equal to a horizontal length of slide bars 48. According to an example embodiment of the invention side supports 46 may present inwardly facing slot 60. Inwardly facing slot 60 is sized and adapted to receive a portion of slide bars 48 therein. According to an example embodiment of the invention side supports 46 are adapted to permit limited movement of slide bars 48 therebetween. By limited movement it is meant to slide bars 48 may move up to a certain extent before impinging on a portion of side supports 46 and may move down to a certain extent before impinging on a portion of side supports 46.

Slide bars 48 are sized to fit between side supports 46. Slide bars 48 generally include body 62 presenting narrowed central portion 64, broader end portions 66 and cutting-edge section engaging studs 68. End portions 66 further include side support engaging portions 70. Narrowed central portion 64 presents biasing member engaging portion 72.

Biasing members 50 may include for example compression springs 74 or other compressible, resilient members that provide a downward biasing force against slide bars 48. In the depicted embodiment biasing members 50 include four compression springs 74. This number or configuration should not be considered to be limiting. In the depicted embodiment, biasing members 50 are located between biasing member bosses 56 and narrowed central portion 64 of slide bars 48.

Figure 5:
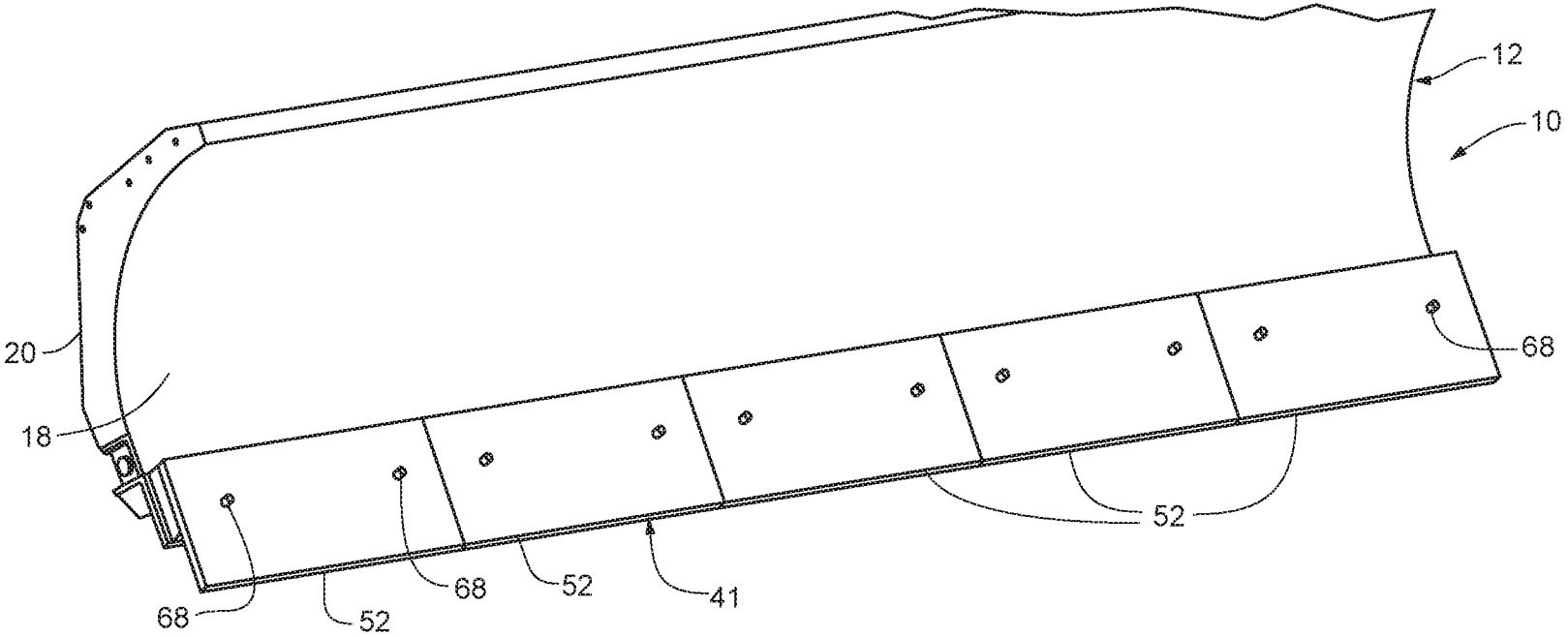
FIG. 5 is a perspective view of an example embodiment of the invention depicting replaceable movable cutting edges.
Figure 6:
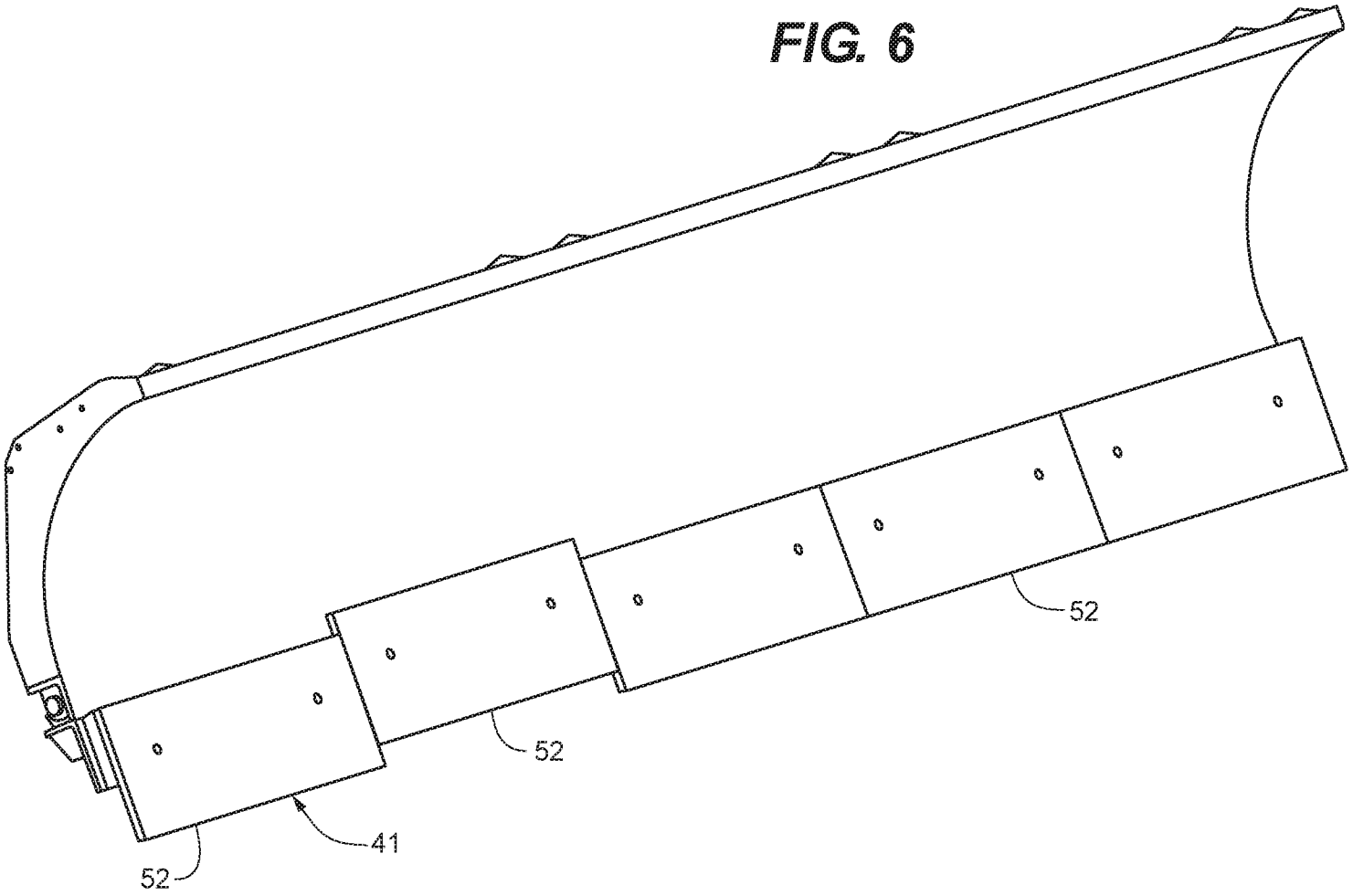
FIG. 6 is a perspective view of an example embodiment of the invention depicting one of the replaceable movable cutting edges in a partially retracted position.

Referring now to FIGS. 5 and 6, cutting-edge sections 52 are each fastened or coupled to one of slide bars 48 for example via studs 68. Bolts or other fasteners may also be utilized. Accordingly, slide bars 48 are slidably secured between side supports 46 and cutting-edge sections 52 are independently movable along with slide bars 48 while being biased downwardly by biasing members 50. FIG. 6 illustrates the independent movability of cutting-edge sections 52 as coupled to slide bars 48.

Figure 7:
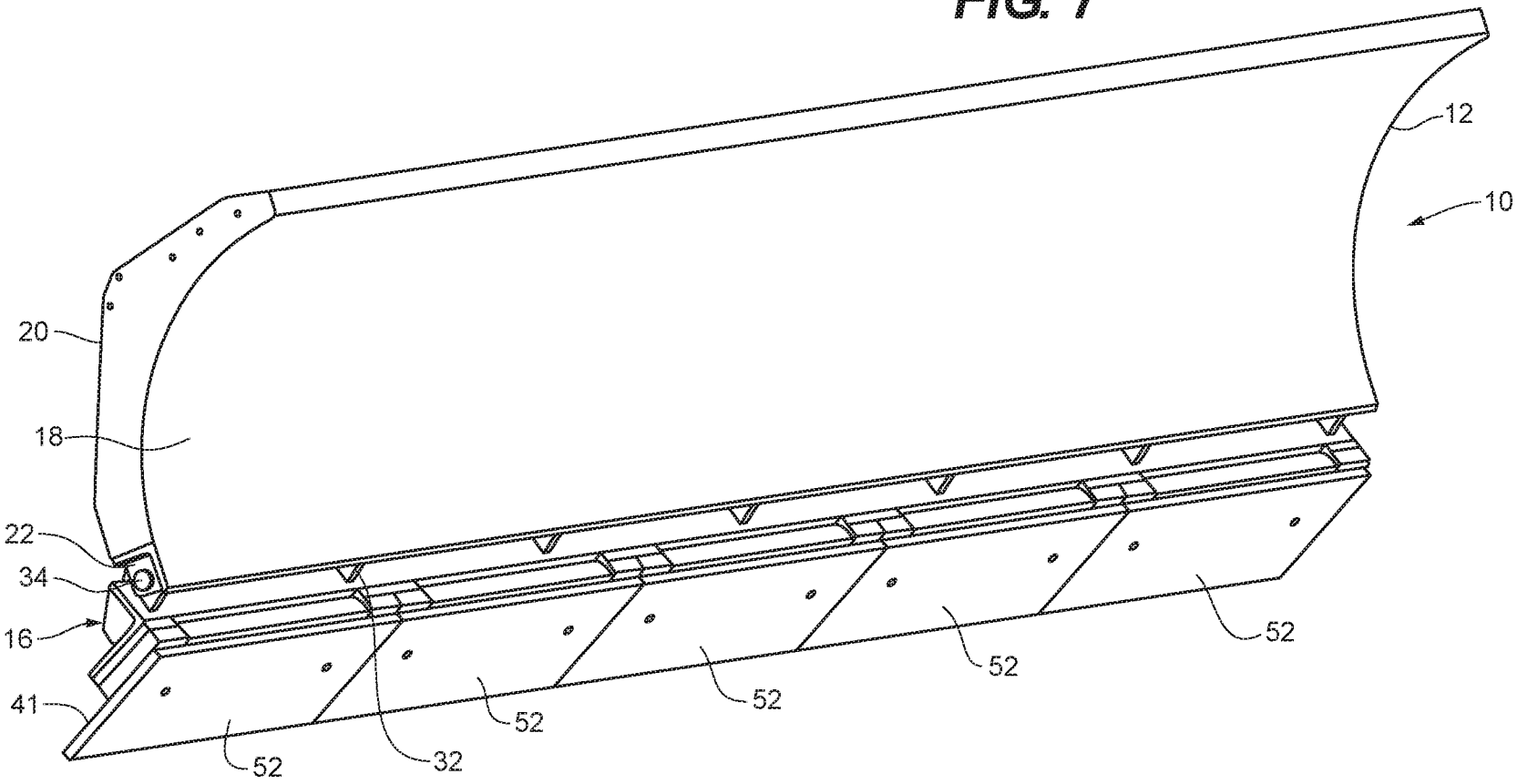
FIG. 7 is a perspective view of an example embodiment of the invention depicting the operation of the prior art trip cutting edge along with an example embodiment of the invention.

Referring to FIG. 7, it can be seen that cutting-edge trip mechanism 16 as known in the prior art or, alternately a trip moldboard is still operable in its normal fashion in concert with the example embodiment of the invention depicted.

In operation, referring to FIGS. 1 and 2, prior art to cutting-edge 14 is removed from moldboard 12 or from cutting-edge support structure 30 if cutting-edge trip mechanism 16 is present. This leaves a lower portion of moldboard 12 or cutting-edge support structure 30 exposed.

According to an example embodiment of the invention, flexible snowplow cutting edge 41 is provided as a kit including all the appropriate parts to install flexible snowplow cutting edge 41 on existing moldboard 12 or cutting-edge support structure 30.

Backing plate 44 is secured to moldboard 12 or cutting-edge support structure 30 by use of fasteners, for example bolts, secured into existing bolt holes 42. Backing plate 44 presents biasing member bosses 56 extending outwardly away therefrom. Side supports 46 are secured to backing plate 44 via fasteners with slide bars 48 each being located between a pair of side supports 46. Biasing members 50 are inserted between biasing member bosses 56 and narrowed central portion 64 of slide bars 48. End portions 66 are engaged to slots 60 of side supports 46 so that slide bars 48 are slidably movable between side supports 46.

Cutting-edge sections 52 are positioned overlying slide bars 48 so that cutting-edge section engaging studs 68 pass through cutting-edge sections 52. Cutting-edge sections 52 are then secured to slide bars 48 via nuts or other fasteners (not shown).

As depicted in FIG. 6, cutting-edge sections 52 are then able to move generally upwardly in response to contact with an obstruction order to move generally downwardly in response to a low spot in the pavement or other surface to be cleared of snow. Biasing members 50 bias cutting-edge sections 52 generally downwardly.

Referring to FIG. 7, in the case of snow plow blade 10 having cutting-edge trip mechanism 16 it can be seen that the application of flexible snowplow cutting edge 41 does not alter the behavior or action of cutting-edge trip mechanism 16. Accordingly, this allows snow plow blade 10 that is equipped with flexible snowplow cutting edge 41 to operate normally in this regard. Further, in the case of a trip moldboard operation of this feature is also not altered by the addition of flexible snowplow cutting edge 41.

Example embodiments of the invention also include a method of modifying a snow plow, including securing at least one elongate backing plate to a lower edge of a snow plow moldboard or to a cutting edge trip mechanism proximate the lower edge of the snow plow moldboard, the elongate backing plate having a long axis and the elongate backing plate presenting a plurality of biasing member engaging structures; engaging a plurality of slide bars to the elongate backing plate in slidable relation; locating the slide bars proximate one another along the long axis of the elongate backing plate and such that the slide bars are slidable generally perpendicular to the long axis; positioning a plurality of biasing members between the biasing member engaging structures and the slide bars such that the slide bars are biased generally perpendicular to the long axis toward a surface to be cleared of snow; and securing a plurality of replaceable cutting edge sections each to one of the plurality of slide bars and locating each of the replaceable cutting edge sections adjacent at least one of the other replaceable cutting edge sections.

A further example embodiment of the method further includes securing a plurality of side supports adjacent to and on each side of each of the plurality of slide bars thereby facilitating slidable movement of the slide bars.

A further example of the method further includes securing the plurality of biasing members such that each of the biasing members engages each of the plurality of slide bars at a narrowed central portion of the slide bar.

Yet another example embodiment of the method further includes making each of the plurality of slide bars engage two of the plurality of side supports, with each of the plurality of slide bars positioned between two of the plurality of side supports.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of 35 U.S.C. § 112(f) are not to be invoked unless the specific terms "means for" or "step for" are recited in a claim.

The invention claimed is:

1. A snow plow cutting edge, comprising:

at least one elongate backing plate coupled to a lower edge of a snow plow moldboard or to a cutting edge trip mechanism proximate the lower edge of the snow plow moldboard or integrally formed with the cutting edge trip mechanism or integrally formed with snow plow moldboard, the elongate backing plate having a long axis and the elongate backing plate presenting a plurality of biasing member engaging structures each of the plurality of biasing member engaging structures having a second long axis parallel to the long axis of the elongated backing plate;

a plurality of slide bars engageable to the elongate backing plate in slidable relation, the slide bars presenting a narrowed central portion located horizontally between two broader end portions and being arranged proximate one another along the long axis of the elongate backing plate and being slidable generally perpendicular to the long axis;

a plurality of replaceable cutting edge sections, each being operably engageable to the plurality of slide bars, the replaceable cutting edge sections being arranged proximate one another along the long axis of the elongate backing plate and being slidable generally perpendicular to the long axis, each of the replaceable cutting edge sections being removably operably attached to the plurality of slide bars and being located adjacent at least one of the other replaceable cutting edge sections; and a plurality of biasing members compressibly engaged between the biasing member engaging structures and the narrowed central portion of the slide bars such that the replaceable cutting edge sections secured to the plurality of slide bars are biased generally perpendicular to the long axis toward a surface to be cleared of snow.

2. The flexible snow plow cutting edge as claimed in claim 1, further comprising:

a plurality of side supports located adjacent to and on each side of each of the slide bars thereby facilitating slidable movement of the slide bars.

3. The snowplow cutting edge as claimed in claim 1, wherein the biasing members comprise compression springs or other compressible resilient members.

4. The snowplow cutting edge as claimed in claim 1, wherein the biasing member engagement structures comprise biasing member bosses extending outwardly away from the at least one elongate backing plate.

5. The snowplow cutting edge as claimed in claim 2, wherein each of the plurality of slide bars engages two of the plurality of side supports, each of the plurality of slide bars being positioned between two of the plurality of side supports.

6. A kit for modifying a snowplow cutting edge, the kit comprising:

at least one elongate backing plate coupleable to a lower edge of a snow plow moldboard or to a cutting edge trip mechanism proximate the lower edge of the snow plow moldboard, the elongate backing plate having a long axis and the elongate backing plate presenting a plurality of biasing member engaging structures;

a plurality of replaceable cutting edge sections engageable to the elongate backing plate in slidable relation, the replaceable cutting edge sections structured to be arranged proximate one another along the long axis of the elongate backing plate and being slidable generally perpendicular to the long axis;

a plurality of slide bars engageable to the elongate backing plate in slidable relation, the slide bars presenting a narrowed central portion located horizontally between two broader end portions and being arranged proximate one another along the long axis of the elongate backing plate and being slidable generally perpendicular to the long axis; and a plurality of compressible biasing members that can be engaged between the biasing member engaging structures and the narrowed central portion such that the replaceable cutting edge sections are biased generally perpendicular to the long axis toward a surface to be cleared of snow.

7. The kit as claimed in claim 6, further comprising a plurality of side supports locatable adjacent to and on each side of each of the slide bars thereby facilitating slidable movement of the slide bars.

8. The kit as claimed in claim 6, wherein the biasing members comprise compression springs or other resilient compressible members.

9. The kit as claimed in claim 6, wherein the biasing member engagement structures comprise biasing member bosses extending outwardly away from the at least one elongate backing plate.

10. The kit as claimed in claim 7, wherein each of the plurality of slide bars is engageable to two of the plurality of side supports, each of the plurality of slide bars being positioned between two of the plurality of side supports.

11. A method of modifying a snow plow, comprising:

securing at least one elongate backing plate to a lower edge of a snow plow moldboard or to a cutting edge trip mechanism proximate the lower edge of the snow plow moldboard, the elongate backing plate having a long axis and the elongate backing plate presenting a plurality of biasing member engaging structures each of the plurality of biasing member engaging structures having a second long axis parallel to the long axis of the elongated backing plate;

engaging a plurality of slide bars to the elongate backing plate in slidable relation, the slide bars presenting a narrowed central portion located horizontally between two broader end portions and being arranged proximate one another along the long axis of the elongate backing plate and being slidable generally perpendicular to the long axis;

engaging a plurality of replaceable cutting edge sections to the plurality of slide bars;

locating the replaceable cutting sections proximate one another along the long axis of the elongate backing plate and such that the replaceable cutting edge sections are slidable generally perpendicular to the long axis;

positioning a plurality of compressible biasing members between the biasing member engaging structures and the narrowed central portion of the slide bars such that the slide bars are biased generally perpendicular to the long axis toward a surface to be cleared of snow; and securing the plurality of replaceable cutting edge sections adjacent at least one of the other replaceable cutting edge sections.

* * * * *